US009734803B2

(12) United States Patent
Klanner et al.

(10) Patent No.: US 9,734,803 B2
(45) Date of Patent: Aug. 15, 2017

(54) MUSICAL STRING

(71) Applicant: Thomastik-Infeld Gesellschaft m.b.H, Vienna (AT)

(72) Inventors: Franz Klanner, Vienna (AT); Bernhard Rieger, Vienna (AT)

(73) Assignee: Thomastik-Infeld Gesellschaft m.b.H., Vienna (AT)

( * ) Notice: Subject to any disclaimer, the term of this patent is extended or adjusted under 35 U.S.C. 154(b) by 0 days.

(21) Appl. No.: 15/193,848

(22) Filed: Jun. 27, 2016

(65) Prior Publication Data

US 2017/0004810 A1 Jan. 5, 2017

(30) Foreign Application Priority Data

Jul. 2, 2015 (AT) ..... 425/2015

(51) Int. Cl.
*G10D 3/10* (2006.01)
*D07B 1/14* (2006.01)

(52) U.S. Cl.
CPC ..... *G10D 3/10* (2013.01); *D07B 1/141* (2013.01)

(58) Field of Classification Search
None
See application file for complete search history.

(56) References Cited

U.S. PATENT DOCUMENTS 4,499,144 A * 2/1985 van Rijswijk ..... A63B 51/02 428/376
5,578,775 A * 11/1996 Ito ..... D01F 11/127 428/364
5,601,762 A * 2/1997 Ferrari ..... A01K 91/00 156/180
6,528,709 B2 * 3/2003 Hebestreit ..... G10D 3/10 84/297 R
8,183,448 B2 * 5/2012 Mueller-Zierach ..... G10D 3/10 84/297 R
8,487,168 B1 * 7/2013 Klukosky ..... G10D 3/10 84/297 S
8,957,293 B2 * 2/2015 Jolk ..... G10D 3/10 84/297 S
9,355,621 B2 * 5/2016 Nesbitt ..... G10D 3/10
(Continued)

FOREIGN PATENT DOCUMENTS

AT 506 135 11/2009
EP 1574234 A1 9/2005
(Continued)

OTHER PUBLICATIONS

Search Report issued by the Austrian Patent Office of Application No. A 425/2015.

*Primary Examiner* — Robert W Horn
(74) *Attorney, Agent, or Firm* — Henry M. Feiereisen, LLC

(57) ABSTRACT

In a musical string (1), in particular for bowed and/or plucked instruments, it is provided that the musical string has a first fluid (6), which is arranged on a first musical string part (2, 4, 5, 9, 10, 11) of the musical string (1), and a second fluid (7), which is arranged on a second musical string part (2, 4, 5, 9, 10, 13) of the musical string (1) and is different from the first fluid (6), wherein the first fluid (6) and the second fluid (7) are arranged to form a first mixing region (15) in at least one first pre-definable oscillating section of the musical string (1).

35 Claims, 2 Drawing Sheets

(56) References Cited

U.S. PATENT DOCUMENTS

| | | | | |
|---|---|---|---|---|
| 9,424,819 | B1 * | 8/2016 | Jones | G10D 3/10 |
| 9,502,008 | B2 * | 11/2016 | Everly | G10D 3/10 |
| 2007/0084329 | A1 * | 4/2007 | Allen | G10D 3/10<br>84/452 R |
| 2008/0236361 | A1 * | 10/2008 | Tambara | G10D 3/10<br>84/297 S |
| 2010/0071529 | A1 * | 3/2010 | Infeld | G10D 3/10<br>84/297 S |
| 2010/0294109 | A1 | 11/2010 | Rieger | |
| 2011/0219933 | A1 * | 9/2011 | Klanner | G10D 3/10<br>84/297 S |
| 2012/0315180 | A1 * | 12/2012 | Soderman | C22C 38/42<br>420/38 |
| 2014/0041506 | A1 * | 2/2014 | Jones | G10D 3/10<br>84/297 S |
| 2014/0311316 | A1 | 10/2014 | Nesbitt | |
| 2016/0104466 | A1 * | 4/2016 | Klanner | G10D 3/10<br>84/297 S |
| 2016/0247491 | A1 * | 8/2016 | Nesbitt | B05D 3/007 |
| 2017/0004810 | A1 * | 1/2017 | Klanner | G10D 3/10 |
| 2017/0061939 | A1 * | 3/2017 | Hartley | G10D 3/10 |

FOREIGN PATENT DOCUMENTS

| | | | |
|---|---|---|---|
| EP | 2 099 022 | | 9/2009 |
| JP | H0910368 | A | 1/1997 |
| JP | 2004202000 | A | 7/2004 |

* cited by examiner

MUSICAL STRING

CROSS-REFERENCES TO RELATED APPLICATIONS

This application claims the priority of Austrian Patent Application, Serial No. A 42512015, filed Jul. 2, 2015, pursuant to 35 U.S.C. 119(a)-(d), the disclosure of which is incorporated herein by reference in its entirety as if fully set forth herein.

BACKGROUND OF THE INVENTION

The present invention relates to a musical string.

The following discussion of related art is provided to assist the reader in understanding the advantages of the invention, and is not to be construed as an admission that this related art is prior art to this invention.

Musical strings have a string core, which is loaded upon stretching of the musical string, and which carries and/or receives the so-called tuning weight. Musical strings for bowed instruments for lower pitches generally have wrappings or winding layers, to increase the mass coating of the musical string.

Musical strings are components which are loaded up to the material limits in operation. The phenomenon that musical strings can sometimes tear is known to musicians. For acoustic reasons, it is better to operate musical strings close to the tensile strength of the core material, since it has been shown that the bending stiffness of a material decreases the more strongly it is loaded, and a low bending stiffness is necessary for generating suitable overtones, therefore a fundamental oscillation with integer harmonic oscillations.

Such strongly loaded components and/or materials fatigue more rapidly, however, than components and/or materials which—as is widespread, for example, in general mechanical engineering—are dimensioned for so-called fatigue strength with additional safeguards, and/or in the case of which such dimensioning is possible. The material fatigue also changes the sound and the playability and/or response of the musical string, wherein the type of the sound changes depends greatly on the construction and manufacturing of the musical string. The sound and/or the playability of the musical string shifts with time in this case increasingly away from the actual and/or original sound character of the respective musical string.

It has been shown that in particular modern high-tech musical strings having plastic fiber core, using which very good results can be achieved with respect to sound and playing technique, can be particularly susceptible to such aging effects. In this case, not only do the clearest sound changes occur in such musical strings, but they also take place more rapidly than in, for example, classical steel core strings, as have been known for over 100 years now.

These changes in sound and playing technique of the musical string force the musician to replace the musical strings, or to accept losses in the quality of his musical performance. The frequently required changes of the musical strings represent a substantial burden for professional musicians. Furthermore, it has been shown that amateur musicians presently intentionally accept losses in sound and response in favor of a lengthened service life, in order to have to replace the strings less often.

It would therefore be desirable and advantageous to provide an improved musical string which obviates prior art shortcomings and which has good properties with respect to sound and playing technique, and also a long service life.

SUMMARY OF THE INVENTION

According to one aspect of the present invention, a musical string, in particular for bowed and/or plucked instruments, includes a first musical string part, a first fluid provided on the first musical string part, a second musical string part, a second fluid provided on the second musical string part, said second fluid being different from the first fluid, and at least one first pre-definable oscillating section in which the first fluid and the second fluid are arranged to form a first mixing region.

A musical string can thus be provided, which has good to outstanding properties with respect to sound and playing technique, and which has a longer service life than musical strings comparable with respect to sound. A musician can thus act at a higher level with respect to sound and playing technique over a longer period of time with a musical string or a corresponding set of musical strings on his instrument, wherein the sound and the playability change lasts over time, in particular worsen, than is the case with conventional musical strings. Changing properties of the string core can be balanced out and/or compensated for by the two different fluids or fluid mixtures.

A musical string can thus be provided which has to be renewed or replaced less often than has heretofore been the case, without having to accept losses in sound at the same time. In addition, valuable and/or rare raw materials are often used in musical strings, for example, gold, silver, platinum, titanium, ruthenium, and the like. The consumption of raw materials can be reduced by the present musical string.

The dependent claims relate to further advantageous embodiments of the invention. Reference is hereby expressly made to the wording of the claims, whereby the claims are incorporated into the description at this point by reference and are considered to be reproduced verbatim.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
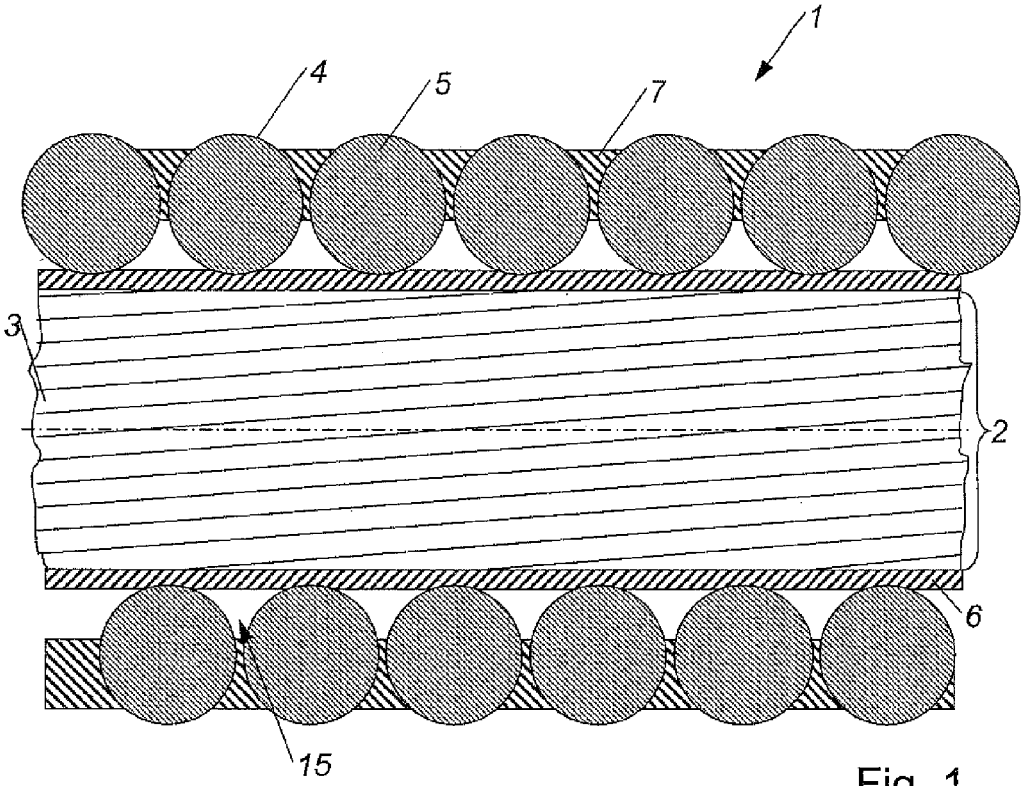
FIG. 1 is a longitudinal section of a first embodiment of a musical string according to the present invention, shown in a stretched state.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments may be illustrated by graphic symbols, phantom lines, diagrammatic representations and fragmentary views. In certain instances, details which are not necessary for an understanding of the present invention or which render other details difficult to perceive may have been omitted.

FIGS. 1 to 4 each show musical strings or part of musical strings 1, in particular for bowed and/or plucked musical instruments, wherein the musical string has a first fluid 6, which is arranged on a first musical string part 2, 4, 5, 9, 10, 11 of the musical string 1, and a second fluid 7, which is different from the first fluid 6, and is arranged on a second musical string part 2, 4, 5, 9, 10, 13 of the musical string 1, wherein the first fluid 6 and the second fluid 7 are arranged to form a first mixing region 15 in at least one first pre-definable oscillating section of the musical string 1.

A musical string 1 can thus be provided, which has good to outstanding properties with respect to sound and playing technique, and which has a longer service life than musical strings 1 which are comparable with respect to sound. A musician can thus act at a higher level with respect to sound and playing technique over a longer period of time with a musical string 1 or a corresponding set of musical strings 1 on his instrument, wherein the sound and the playability change lasts over time, in particular worsen, than is the case with conventional musical strings 1. Changing properties of the string core 2 and/or of at least one winding layer 4, 9 and/or the winding layers 4, 9 can be balanced out and/or compensated for by the two different fluids 6, 7, 8, which can each also be formed as fluid mixtures.

A musical string 1 can thus be provided, which has to be renewed and/or replaced less often than has heretofore been the case, without having to accept losses in sound at the same time. In addition, valuable and/or rare raw materials are often used in musical strings 1, for example, gold, silver, platinum, titanium, ruthenium, and the like. The consumption of raw materials can be reduced by the present musical string 1.

The internal damping has proven to be important in particular for the acoustic properties of a musical string 1. This damping represents, for example, a main differentiating feature between musical strings 1 for bowed instruments and those for plucked instruments. The damping can already be significantly influenced by a single fluid 6, 7, 8 in this case. However, fluids 6, 7, 8 are subject to aging effects, which generally significantly change the properties of a fluid 6, 7, 8. Such aging effects can already occur in this case as a result of the storage of the musical string 1, for example, due to contact of the musical string 1 with specific gases, for example, oxygen. The aging effects of such a fluid 6, 7, 8 in a musical string 1 are particularly strong during and/or due to operation, therefore due to the playing of the affected musical string 1. Upon each of these aging effects of the fluid 6, 7, 8, the affected fluid 6, 7, 8 itself and/or at least one property of the fluid 6, 7, 8, in particular the viscosity thereof, is changed. This also results in changes of the damping properties, and therefore also the acoustic and/or playing-technique properties, of the musical string 1.

The various embodiments shown in the figures are depicted in a simplified illustration. The proportions do not have to correspond to the provided real proportions. Individual parts can be shown in a greatly enlarged view for better comprehension.

One preferred field of use of such musical strings 1 are the instruments of the violin family, therefore the violin, the viola, the cello, and the bass or contrabass or the bass violin. Further preferred instruments for the use of musical strings 1 according to the invention are the viola da gamba and viola d'amore. Such musical strings 1 according to the invention can be provided for all bowed string instruments. Furthermore, the use is also provided for any type of plucked string instruments.

Musical strings 1 according to the invention are provided for generating tonal oscillations, wherein a specific type of musical string 1 is provided for use with a specific type of musical instrument, and furthermore has a tuning tone and a so-called tuning weight as features, wherein the tuning tone specifies the fundamental tone at which a part of the musical string 1—between the end regions thereof—oscillates from the length of the scale of this specific type of musical instrument, when the musical string 1 is loaded with the tuning weight, is therefore stretched, and would be excited to an oscillation, of course.

Musical strings 1 according to the invention have a string core 2, which is provided and designed for the purpose of absorbing the load or the tension, which the musical string 1 is subjected to in the state stretched on a musical instrument. The string core 2 advantageously has a pre-definable plurality of core elements 3, and is therefore not formed by a single strand or wire according to the particularly preferred embodiments. It is particularly advantageous that the core elements 3 are formed as plastic fibers. The core elements 3 formed in this manner then form a so-called fiber bundle core. It can also be provided that the string core 2 is formed as a cable, in particular as a wire cable. Furthermore, the formation of the string core 2 by a single wire or plastic strand can also be provided.

At least one first winding layer 4 is advantageously arranged on the string core 2, which first winding layer 4 has at least one first winding element 5, which is wound in helically formed turns around the string core 2. It can also be provided in this case that two or more winding elements 5 wound adjacent to one another form the first winding layer 4.

The first winding element 5 is advantageously formed from a metal, a metal alloy, or a plastic. In the case of multiple winding elements 5 in the first winding layer 4, it can be provided that winding elements 5 made of different materials are arranged inside the first winding layer 4. The first winding element 5 or further winding elements advantageously have at least one essentially flat circumferential region or side. The first winding element 5 or further winding elements are formed in particular as a round wire or as a flat band having essentially rectangular cross section and pre-definable edge formation. It can also be provided that the first winding element 5 or further winding elements are formed as a round wire, which is ground flat after its arrangement on the musical string 1, and receive an essentially flat outer surface in this manner.

The musical string 1 can have further winding layers in addition to the first winding layer 4, which are formed in accordance with the first winding layer 4, wherein the further winding layers 4 are each arranged on a winding layer, and not directly on the string core 2.

The present musical string 1 has at least two different parts, which are designated as first musical string part 2, 4, 5, 9, 10, 11 and second musical string part 2, 4, 5, 10, 13. Following the musical string parts 2, 4, 5, 9, 10, 11, 13, in each case the reference signs of the parts which can be considered to be the first or second musical string part 2, 4, 5, 9, 10, 11, 13 respectively are listed. In this case, a musical string 1 can have not only precisely one first musical string part 2, 4, 5, 9, 10, 11 and precisely one second musical string part 2, 4, 5, 9, 10, 13. Rather, it can advantageously be provided that a musical string 1 can have in each case a plurality of first musical string parts 2, 4, 5, 9, 10, 11 and a plurality of second musical string parts 2, 4, 5, 9, 10, 13. Furthermore, in the same musical string part 1, a specific musical string part 2, 4, 5, 9, 10, 11, 13 of the relevant musical string 1 can be both first musical string part 2, 4, 5, 9, 10, 11, and also, with respect to another musical string part 2, 4, 5, 9, 10, 11, 13, can be second musical string part 2, 4, 5, 9, 10, 13.

The present musical string 1 has at least one first mixing region 15. It can advantageously be provided that the musical string 1 has a plurality of mixing regions 15. In this case, one embodiment of a musical string 1 can have, for example, a first and a second mixing region 15. A first musical string part 2, 4, 5, 9, 10, 11 and a second musical string part 2, 4, 5, 9, 10, 13 are assigned to the first mixing region. A first musical string part 2, 4, 5, 9, 10, 11 and a second musical string part 2, 4, 5, 9, 10, 13 are also assigned to the second mixing region. Each mixing region therefore has, considered alone, a first and a second musical string part 2, 4, 5, 9, 10, 11, 13. In this case, the first musical string part 2, 4, 5, 9, 10, 11 of the first mixing region 15 can differ from the first musical string part 2, 4, 5, 9, 10, 11 of the second mixing region. It can also be provided that the second musical string part 2, 4, 5, 9, 10, 13 of the first mixing region 15 differs from the second musical string part 2, 4, 5, 9, 10, 13 of the second mixing region. For example, it can also be provided that the second musical string part 2, 4, 5, 9, 10, 13 of the first mixing region 15 is simultaneously the first musical string part 2, 4, 5, 9, 10, 11 of the second mixing region.

The first musical string part 2, 4, 5, 9, 10, 11 is advantageously the string core 2 of the musical string 1 and/or a first circumferential section 11 of the string core 2 and/or a first cross-sectional section of the string core 2 and/or the first winding layer 4 of the musical string 1 and/or the at least one first winding element 5 of the first winding layer 4 and/or a second winding layer 9 of the musical string and/or at least one second winding element 10 of the second winding layer 9.

The second musical string part 2, 4, 5, 9, 10, 13 is advantageously the string core 2 of the musical string and/or a second circumferential section 13 of the string core 2 and/or a second cross-sectional section of the string core 2 and/or the first winding layer 4 of the musical string 1 and/or the first winding element 5 of the first winding layer 4 and/or the second winding layer 9 of the musical string 1 and/or the second winding element 10 of the second winding layer 9.

It is provided in this case that the first musical string part 2, 4, 5, 9, 10, 11 is different from the second musical string part 2, 4, 5, 9, 10, 13.

The present musical string 1 has at least one first fluid 6 or fluid mixture and one second fluid 7 or fluid mixture, which is different therefrom. Preferred embodiments of the first and second fluids 6, 7 are described hereafter. In the following the term fluid is used in a generic sense and may also include a fluid mixture. Furthermore, it can be provided that the terms first fluid 6, second fluid 7, and optionally third fluid 8 can be exchanged with one another.

In the scope of the development process of the present musical string 1, experimental strings were also manufactured, in which only one fluid was arranged on a musical string part 2, 4, 5, 9, 10, 11, 13—in the meaning of the present discussion. This one fluid was arranged in this case, for example, on a first circumferential section 11 of the string core 2, wherein no fluid was arranged on the second, circumferential section 13 of the string core 2. In general, the one fluid was only arranged on a partial region in this case, so that a fluid could be distributed or propagate further on the specific musical string part 2, 4, 5, 9, 10, 11, 13. Such experimental strings have heretofore not proven to be as outstanding, however, as the present musical strings having at least two fluids 6, 7 and a first mixing region 15.

The first fluid 6 is arranged on or at the first musical string part 2, 4, 5, 9, 10, 11. The second fluid 7 is arranged on or at the second musical string part 2, 4, 5, 9, 10, 13. It is provided in this case that the first fluid 6 and the second fluid 7 are arranged to form a first mixing region 15 in at least one first pre-definable oscillating section of the musical string 1.

The two fluids 6, 7 are therefore advantageously arranged adjacent to one another, and in such a way that in this case the two fluids 6, 7 are already in contact, therefore directly adjoin one another, or so that the two fluids 6, 7 are arranged such that the second fluid 7 only comes into contact with the first fluid 6 in the event of a pre-definable intended excitation of the musical string 1, and form the first mixing region 15 having a mixing region viscosity, wherein the mixing region viscosity is different from the first viscosity. In the latter embodiment, the two fluids 6, 7 are therefore arranged spaced apart from one another, and first come into contact due to the motion of the musical string 1 and the flexing work occurring in this case.

Upon the mutual contact of the two fluids 6, 7, the formation of a first mixing region 15 occurs, wherein the fluid mixture has different properties in this mixing region 15 than the first or second fluid 6, 7, respectively, each considered per se. As soon as the first fluid 6 and the second fluid 7 can be in contact, a change of the properties of one of the fluids 6, 7 can already occur as a result of chemical and/or physical balancing procedures, as well as the formation of a first mixing region 15, even if the musical string 1 is not moved at the same time. The type and speed of such balancing procedures is dependent above all in this case on the first and second fluids 6, 7. The formation of the first mixing region 15 is assisted or accelerated by moving the musical string 1.

The afore-mentioned properties relate to respective properties of the participating fluids 6, 7, 8 in the case of a specific state of the musical string 1 at a specific point in time. Opening and closing of intermediate spaces of the turns of a winding layer 4, 9 occurs in the case of oscillating musical strings 1. In this case, pumping effects and relative movements of individual regions in relation to one another occur, as a result of which forces act on the fluids 6, 7, 8. The fluids 6, 7, 8 change the properties thereof due to the internal forces acting thereon, as already described. By way of the selection of more favorable combinations of first and second fluid 6, 7, this change of the first fluid 6 or this change of the properties of the first fluid 6 is intentionally compensated for. Aging effects can thus be balanced out and/or compensated for. Changes of the damping of the musical string over time can thus be compensated for.

To determine the respective properties of the individual fluids 6, 7, 8, in particular for the purpose of comparing the fluids 6, 7, 8 to one another, it is provided that the fluids 6, 7, 8 to be compared are each tested using the same testing method. Thus, for example, to determine the viscosity, it is provided that the two fluids 6, 7, 8 are tested using the same viscosimeter with identical test conditions to obtain comparable measurement results. It can be provided in this case that the fluids 6, 7, 8 to be compared are subjected to mechanical loads before such a test, for example, on the basis of dynamically changing movements and/or shear forces, wherein it is provided that all fluids 6, 7, 8 to be tested and compared were subjected to identical loads.

As already stated, it is provided that said mixing region 15 forms or is formed at least within a first oscillating section, which is thus designated, of the musical string 1. In this case, at least one longitudinal section or a part of the musical string in the longitudinal extension thereof is designated as the oscillating section of the musical string 1. It can be provided in this case that the first oscillating section extends over the entire region of a musical string 1 which is located between the colored fiber wraps made of silk or artificial silk which are typically located at both ends, which fiber wraps are attached to identify the musical string 1. The relevant ends of the musical string 1 are provided for suspending the musical string 1 on a string holder or fastening the musical string 1 on a peg of a musical instrument.

It is advantageously provided that the first oscillating section does not occupy the entire length of the musical string 1. It can be provided in this case that the first oscillating section extends over the scale region of the musical string 1. The scale region is in this case the longitudinal section of the musical string 1 which, with stretched musical string 1—in instruments of the violin family—is arranged between the bridge and the nut. Because of the quite similar geometries of the instruments, this region can be easily identified on a musical string 1. In other string instruments, the oscillating regions of a musical string 1 used for generating sound are also easy to identify.

It can particularly advantageously be provided that the first oscillating section occupies a significantly shorter longitudinal section of the musical string 1 than the scale length. The first oscillating section is advantageously arranged in this case within the scale length of the musical string 1. For example, in the case of a musical string 1 for a violin, which typically has a scale length of 320 mm to 325 mm, a first oscillating section of 100 mm length of the musical string 1 can be provided, which is arranged on the musical string 1 such that it, when the relevant musical string 1 is arranged on a violin, comes to rest closest to the bridge on the side of the musical string 1 facing toward the nut of the instrument.

Multiple such oscillating sections can also be provided on a musical string 1, therefore one first oscillating section and at least one second oscillating section.

As is already disclosed in the statements on the first and second musical string parts 2, 4, 5, 9, 10, 11, 13, the present invention can be applied in a plurality of possible implementations of the first and the second musical string part 2, 4, 5, 9, 10, 11, 13. The particularly preferred embodiments are listed hereafter. In this case, to avoid confusion, the respective naming of which part the first musical string part 2, 4, 5, 9, 10, 11 is and which part the second musical string part 2, 4, 5, 9, 10, 13 is were omitted. This is disclosed in any case from which of the musical string parts 2, 4, 5, 9, 10, 11, 13 the first fluid 6 is arranged on and which the second fluid 7 is arranged on. The preferred embodiments listed hereafter have each been shown to be particularly effective in practice and/or during tests.

According to a first preferred embodiment of a present musical string 1, it is provided that the first fluid 6 is arranged on the string core 2 and/or between core elements 3 of the string core 2, and the second fluid 7 is arranged on the first winding layer 4 and/or on turns of the first winding element 5. In this case, above all aging procedures at the contact regions between string core 2 and first winding layer 4 can be compensated for.

FIG. 1 shows the first embodiment of a corresponding musical string 1, wherein the string core 2 is formed as a fiber bundle core having a plurality of core elements 3. The first fluid 6 is arranged on the string core 2. The first winding layer 4 is arranged thereon and/or partially penetrating therein. FIG. 1 shows the detail of the musical string 1 in this case in the stretched state. The distances between the turns of the first winding element 5 are clearly shown. The second fluid 7 is arranged between these turns.

In this case, a different concentration of the second fluid 7 can generally also be provided in different distances between the turns. This can also be provided in other embodiments of a present musical string 1.

Figure 2:
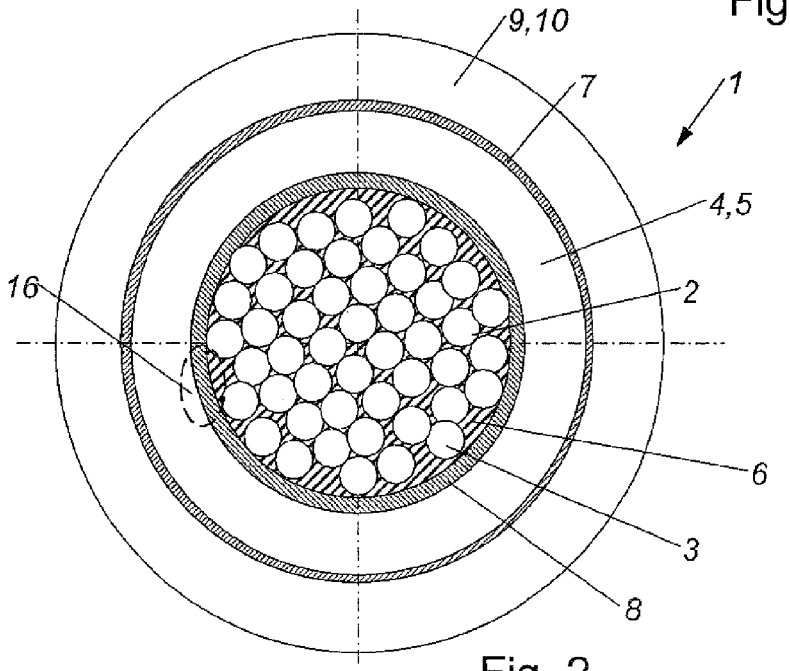
FIG. 2 is a cross section of a second embodiment of a musical string according to the present invention.

Furthermore, it can be provided that a third fluid 8 or fluid mixture is arranged between the string core 2 and the first winding layer 4, wherein the third fluid 8 or fluid mixture is different from the first and/or second fluid 6, 7 or fluid mixture. The third fluid 8 or the third fluid mixture has a third viscosity in this case. A further improved or expanded possibility for adapting or influencing the damping properties of the musical string 1 exists due to the third fluid 8, in particular the compensation for changes over time of the damping properties of the musical string 1. FIG. 2 shows a second preferred embodiment of a present musical string 1 designed in this manner, wherein the first fluid 6 is arranged on or inside the string core 2, and wherein the third fluid 8 is arranged between string core 2 and first winding layer 4. In this case, as a further consequence a triple mixing region is formed during the playing of the musical string 1, which is only illustrated in FIG. 2 by a dashed ellipse.

The string core 2 of the musical string 1 according to FIG. 2 has a plurality of core elements 3, which are shown in section in FIG. 2, wherein shading of the core elements 3 has been omitted for reasons of comprehensibility, however. In this case, the core elements 3 are each wetted in a predefinable manner using the first fluid 6 or fluid mixture, as also shown in FIG. 2. The extent of the adhesion/sliding friction occurring between the individual core elements 3 can thus be set in a pre-definable manner.

The musical string 1 according to FIG. 2 furthermore optionally has a second winding layer 9, which is arranged helically around the first winding layer 4 in a manner corresponding thereto. Still further winding layers can also be provided around the second winding layer 9.

Figure 3:
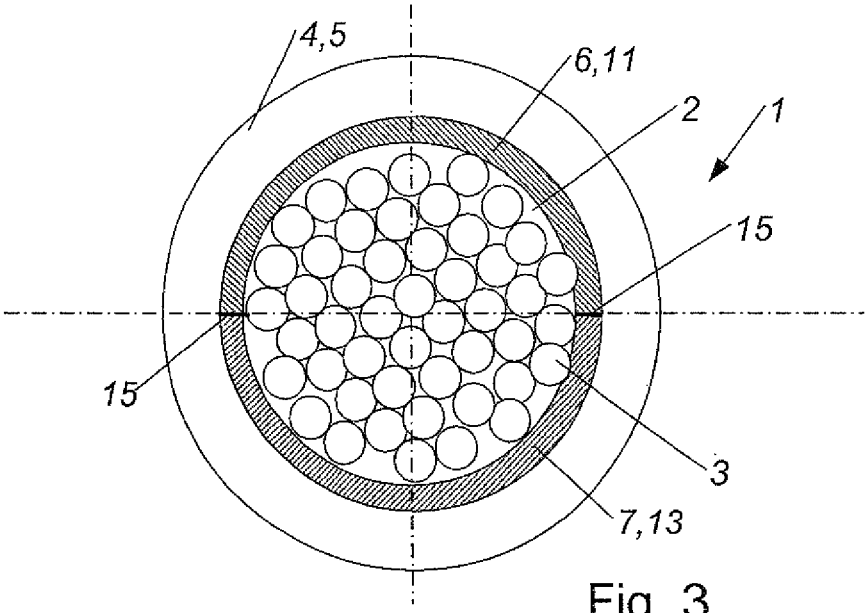
FIG. 3 is a cross section of a third embodiment of a musical string according to the present invention.

According to a third preferred embodiment of a present musical string 1, it is provided that the first fluid 6 is arranged on a first circumferential section 11 of the string core 2, and the second fluid 7 is arranged on a second circumferential section 13 of the string core 2. A musical string 1 designed in this manner is shown in FIG. 3. In this case, influence can be taken in particular on the torsional vibration behavior of the musical string 1.

Figure 4:
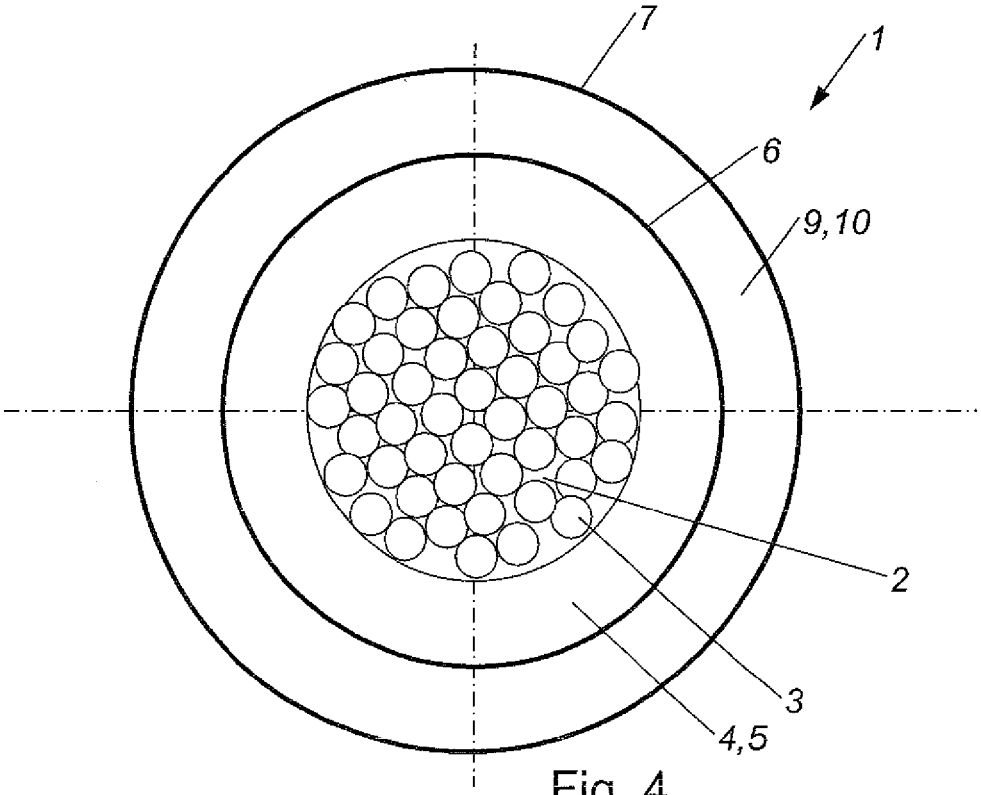
FIG. 4 is a cross section of a fourth embodiment of a musical string according to the present invention.

According to a fourth preferred embodiment of a present musical string 1, it is provided that the first fluid 6 is arranged on the first winding layer 4 and/or on the turns of the first winding element 5, and the second fluid 7 is arranged on the second winding layer 9 of the musical string 1 and/or on turns of the first winding element 10. FIG. 4 shows a schematic illustration of such a musical string 1 in cross section, wherein the first or second fluid 6, 7, respectively, is only shown by a thick black line in each case. It is advantageously provided in this case that the two fluids 6, 7 are arranged corresponding to the second fluid 7 in FIG. 1, wherein an arrangement deviating therefrom can also be provided, however. Changes in the region between the two winding layers 4, 9 can thus be compensated for in particular.

According to a fifth preferred embodiment of a present musical string 1, it is provided that the first fluid 6 is arranged on the first cross-sectional section of the string core 2, and the second fluid 7 is arranged on the second cross-sectional section of the string core 2. This embodiment is similar to the third preferred embodiment, wherein, however, the cross section of the string core 2 and not its circumference accommodates the first and second fluids 6, 7. This embodiment is not shown in the figures.

According to a sixth preferred embodiment of a present musical string 1, it is provided that the first fluid 6 is arranged on a first winding layer circumferential section of the first winding layer 4, and the second fluid 7 is arranged on a second winding layer circumferential section of the first winding layer 4. Above all the torsional vibration behavior of the musical string 1 can also be favorably influenced using this embodiment variant (not shown). This is relevant insofar as torsional vibrations cannot be avoided above all in bowed strings, which can be particularly noticeable in the sound picture of a correspondingly covered musical instrument.

Instead of the expression "fluid 6, 7, 8 or fluid mixture", only the term fluid 6, 7, 8 can be specified hereafter, wherein a fluid mixture is also described, if it is not specifically excluded in the text.

The first fluid 6 is different from the second fluid 7. The two fluids 6, 7 therefore have a different chemical composition and/or different properties. This also applies to the third, fourth, and fifth fluids 8 also introduced hereafter.

It can be provided in this case that the at least two fluids 6, 7, 8 are insoluble in one another. However, it is advantageously provided that one of the fluids 6, 7, 8 is soluble in another of the fluids 6, 7, 8.

It is advantageously provided in this case that the first fluid 6 or fluid mixture has a first viscosity, and the second fluid 7 or fluid mixture has a second viscosity, and the first viscosity is different from the second viscosity. For the comparison of the two viscosities, it is provided that they are to be compared with essentially identical comparison conditions, for example, with the aid of a viscosimeter.

It is particularly advantageously provided that, in the event of a pre-definable intended excitation of the musical string 1, the second fluid 7 comes into contact with the first fluid 6, and forms said first mixing region 15 having a mixing region viscosity, wherein the mixing region viscosity is different from the first viscosity. In particular the playing, generation of sound or noise, or also making music using the musical string 1 on a corresponding musical instrument provided for this musical string 1 is understood as the pre-definable intended excitation of the musical string 1. The mixing region, in which both components of the first and of the second fluid 6, 7 are prevalent, forms due to the contact of the two fluids 6, 7. Due to the dynamic forces which the musical string 1 is subjected to in operation, this first mixing region 15 becomes increasingly larger and/or deeper with progressive operation of the musical string 1, and it displaces more and more the regions in which only the first fluid 6 is prevalent. Therefore, the viscosity is also changed more and more from the first viscosity toward the mixing region viscosity.

In particular, it is provided in this case that the second fluid 7 and the second musical string part 2, 4, 5, 9, 10, 13 are formed such that upon the pre-definable intended excitation of the musical string 1, the second fluid 7 penetrates free spaces of the second musical string part 2, 4, 5, 9, 10, to form the first mixing region 15. In the first preferred embodiment of the musical string 1, it would then be provided, for example, that the second fluid 7 is formed and the second winding layer 4 is arranged such that upon the pre-definable intended excitation of the musical string 1, the second fluid 7 penetrates the first winding layer 4 to form the mixing region 15. Therefore, advantageously both the winding density of the first winding layer 4, that is to say, how closely adjacent to one another the individual turns of the first winding layer 4 are arranged, and/or the properties of the second fluid 7 are formed such that the second fluid 7 at least regionally, and at least during the dynamic opening and closing of the turns as a result of the stretching and bending of the musical string 1 during playing, penetrates the first winding layer 4 and comes into contact with the first fluid 6 in this manner. The described procedures also occur in a corresponding manner in altered form in the other musical string parts 2, 4, 5, 9, 10, 11, 13.

It has been shown that the location or the position of the first oscillating section on the first musical string 1 can also have great relevance. As can be provided, as already described, the first oscillating section can have a shorter length than the scale length, so that this oscillating section can be arranged as the, for example, shorter longitudinal section or as a part of the musical string 1 within the overall length of the musical string 1, but advantageously within the longitudinal section of the musical string 1 provided for generating sound.

Local heating of the musical string 1 occurs in the region of a bowing point, which heating can influence the properties of the first and above all the second fluids 6, 7. The region of the musical string 1, at which a bow is in contact with the musical string 1 for the purpose of exciting oscillation, is designated in this case as a bowing point. Due to this local heating, if the second fluid 7 is arranged on the first winding layer 4, the passage of the second fluid 7 through this layer can be accelerated. This can also be taken into consideration in the adaptation of the two fluids 6, 7, the density of the first winding layer 4, and the position of the first oscillating section.

During the bowing procedure, not only said local heating occurs in the region of the bowing point, but rather also a transfer of rosin from the bow hairs to the musical string 1. The bow hairs of a bow for bowing a musical string are treated using rosin by the musician before the playing or bowing. The rosin acts in this case as an adhesive/lubricant and is required for the bowed sound generation using a musical string. During the bowing, rosin is emitted from the bow hairs, and forms a fine powder layer on the so-called top of a string instrument. However, a part of the emitted rosin penetrates into the musical string 1 itself in this case, and results in a sound picture which becomes duller in conventional musical strings. This effect can be compensated for by suitable selection of the first and second fluids 6, 7 and positioning of the first oscillating section in the region of the bowing point. The rosin penetrating from the outside cooperates in this case with the first and/or second fluid 6, 7.

As a result of the movement of the musical string 1, forced mixing of the first fluid 6 with the second fluid 7 occurs regionally, whereby the properties of the two fluids 6, 7 can be changed. In particular, the viscosity of the first fluid 6 can thus be changed, and therefore the damping of the string core 2 directly. The damping of the string core 2 has great influence on the sound and playability of a musical string 1.

In this context, it is furthermore provided in particular that the first fluid 6 or fluid mixture and the second fluid 7 or fluid mixture are formed such that upon contact, in particular the regional mixing, of the first fluid 6 or fluid mixture with the second fluid 7 or fluid mixture, the first viscosity is changed in a pre-definable manner. The damping properties of the respective musical string part 2, 4, 5, 9, 10, 11, 13 can thus be adapted to the changes thereof in the course of aging and at least partially balanced out. In particular the damping in the string core 2 can thus be reduced over time, whereby aging procedures inside the string core 2 can be compensated for.

As already described, it is provided that, inside the first oscillating section of the musical string 1, at least one first fluid 6 and a different second fluid 7 are arranged at different and adjacent parts of the musical string 1. In a refinement of the present musical string 1, it is furthermore advantageously provided that in a second pre-definable oscillating section of the musical string 1, which is different from the first pre-definable oscillating section of the musical string 1, a fourth fluid, which is different from the first fluid 6, is arranged to form a second mixing region on the first musical string part 2, 4, 5, 9, 10, 11, and a fifth fluid, which is different from the second fluid 7, is arranged at the second musical string part 2, 4, 5, 9, 10, 13. Different properties or requirements of different oscillating sections or longitudinal sections of the musical string 1 can thus be reacted to.

It can be provided that the respective fluids 6, 7, 8 are arranged essentially consistently or with a constant length distribution inside the first or second oscillating section. It can advantageously be provided that the first fluid 6 or fluid mixture and/or the second fluid 7 or fluid mixture and/or the third fluid 8 or fluid mixture and/or the fourth fluid or fluid mixture and/or the fifth fluid or fluid mixture has a pre-definable variable, therefore not constant length distribution within the first and/or second oscillating section of the musical string 1. Individual properties of a musical string type can thus be compensated for or amplified still more accurately and intentionally.

It is advantageously provided that the first fluid 6 or fluid mixture and/or the second fluid 7 or fluid mixture and/or the third fluid 8 or fluid mixture and/or the fourth fluid or fluid mixture and/or the fifth fluid or fluid mixture is formed as an essentially organic fluid or fluid mixture. An organic fluid is considered in this case to be in a fluid which has substantial components of organic substances, or in which the organic substances primarily determine the properties of the respective fluid. In particular, it is provided that the fluid 6, 7, 8 comprises at least 51 mass-% organic components.

The first fluid 6 and/or the second fluid 7 and/or the third fluid 8 and/or the fourth fluid and/or the fifth fluid is advantageously a fluid or fluid mixture which is more or less liquid or pourable at room temperature. Preferably, none of the fluids for use in the present musical strings are fluids which are gaseous at typical environmental parameters and/or room temperature, advantageously 294 K and 760 Torr. Such gaseous parts can be a component of one of the fluids, wherein, however, the fluid formed in this manner is in turn amorphous and/or liquid at room temperature.

Several preferred components of the fluids 6, 7, 8 and/or fluid mixtures are described hereafter.

According to one particularly preferred embodiment, the first fluid 6 or fluid mixture and/or the second fluid 7 or fluid mixture and/or the third fluid 8 or fluid mixture and/or the fourth fluid or fluid mixture and/or the fifth fluid or fluid mixture contains a gel or is a gel. Gels have advantages with respect to the adhesion to the first and/or second musical spring part. Further possibilities thus result, for example, for influencing the passage behavior of the second fluid 7 through the first winding layer 4 in a pre-definable manner, as well as the mixing properties between first and second fluid 6, 7.

It can advantageously be provided that a type of barrier layer is built up by means of a fluid 6, 7 formed as a gel, which slows the mixing of a first fluid 6 with a second fluid 7. In this case, for example, the second fluid 7 itself can be formed as a gel. However, it can also be provided that a third fluid 8 formed as a gel is arranged between a first fluid 6 and a second fluid 7 to slow said mixing.

According to one preferred embodiment variant, it is provided that the first fluid 6 or fluid mixture and/or the second fluid 7 or fluid mixture and/or the third fluid 8 or fluid mixture and/or the fourth fluid or fluid mixture and/or the fifth fluid or fluid mixture contains at least one oil.

It is provided in particular in this case that the oil comprises at least one fatty animal oil and/or at least one fatty vegetable oil and/or at least one ethereal oil and/or at least one mineral oil or mineral oil extract and/or at least one synthetic oil and/or at least one silicone oil and/or at least one silicone paste.

In particular at least one oil from the following group is provided as the fatty vegetable and animal oils: linseed oil, sunflower oil, olive oil, safflower oil; whale oil, cod liver oil, fish oils, soybean oil, canola oil, castor oil, tall oil, or tung oil.

At least one oil from the following group is provided in particular as the ethereal oils: lemon oil, rose oil, apiol, cinnamic aldehyde, anethole, carveol, thymol, camphor, fenchone, linalool, geraniol, neral, or citronellal.

Oils which were produced according to the Fisher-Tropsch method or originate from petroleum processing are advantageously provided as the mineral oil and/or synthetic oil. These oils consist in particular of paraffinic (saturated aliphatic hydrocarbons), naphthenic (saturated cyclic hydrocarbons), and aromatic (cyclic hydrocarbons having aromatic double bond systems) components. Mineral oils advantageously also contain, in addition thereto, alkylenes (olefins) and can have further sulfurous and/or nitrogenous organic compounds. In particular at least one oil from the following group is provided as the mineral oil and/or synthetic oil: heavy oil, light oil, white oil, medical white oil, or paraffin oil.

Furthermore, advantageously at least one silicone oil (diorganopolysiloxane) and/or at least one silicone paste (two-phase systems based on thermally stable silicone oils and non-melting, highly dispersed silicic acid) can advantageously be provided as the oil.

According to one preferred embodiment variant, it is provided that the first fluid 6 or fluid mixture and/or the second fluid 7 or fluid mixture and/or the third fluid 8 or fluid mixture and/or the fourth fluid or fluid mixture and/or the fifth fluid or fluid mixture contains at least one wax or wax mixture.

Waxes are included among the lipids. The main components of these material mixtures are esters of fatty acids (also called waxy acids) having long-chain, aliphatic, primary alcohols, the so-called fatty alcohols. These esters differ in their structure from the fats and fatty oils, which are triglycerides with fatty acids. In addition, these waxes also contain free, long-chain aliphatic carboxylic acids, resin carboxylic acids, ketones, alcohols, and hydrocarbons, and also the derivatives thereof. There is no precise delimitation between waxy acids and fatty acids, since typical fatty acids, such as palmitic acid and stearic acid, also participate in the synthesis of some natural waxes.

It is provided in particular in this case that the wax or wax mixture comprises at least one animal wax and/or at least one vegetable wax and/or at least one mineral wax and/or at least one synthetic wax. Furthermore, microcrystalline waxes can advantageously also be provided.

In particular at least one wax from the following group is provided as an animal wax: wool wax (lanolin), beeswax.

In particular at least one wax from the following group is provided as a vegetable wax: carnauba wax, sugarcane wax, Japan wax, jojoba wax, or candelilla wax.

In particular waxes according to the Fisher-Tropsch method or from petroleum processing are provided as the synthetic wax, wherein in particular kerosene and/or paraffins, for example, hard paraffins and/or soft paraffins, for example, Vaseline, are provided.

In particular at least one wax from the following group is provided as the mineral wax: ozokerite, ceresin, montan wax, peat wax, or sapropel wax.

According to one preferred embodiment, it is provided that the first fluid 6 or fluid mixture and/or the second fluid 7 or fluid mixture and/or the third fluid 8 or fluid mixture and/or the fourth fluid or fluid mixture and/or the fifth fluid or fluid mixture contains at least one fat.

Fats are esters of the trivalent alcohol glycerin (propane-1,2,3-triol) with three, usually different, or dominantly even-numbered and unbranched aliphatic monocarboxylic acids, the fatty acids (triglycerides).

It is provided in particular in this case that the fat comprises at least one lard, in particular pork lard, and/or at least one whale oil and/or at least one suet, in particular deer suet.

According to one preferred embodiment, it is provided that the first fluid 6 or fluid mixture and/or the second fluid 7 or fluid mixture and/or the third fluid 8 or fluid mixture and/or the fourth fluid or fluid mixture and/or the fifth fluid or fluid mixture contains at least one solvent.

It is provided in particular in this case that the solvent comprises at least one protic and/or amphiprotic solvent.

The following are provided in particular as protic solvents: ketones, for example, acetone; lactones such as γ-butyrolactone; lactams such as N-methyl-2-pyrrolidone; nitriles such as acetonitrile; nitro compounds such as nitromethane; tertiary carboxylic acid amides such as dimethyl formamide; urea derivatives such as tetramethyl urea or dimethyl propane urea (DMPU); sulfoxides such as dimethyl sulfoxide (DMSO); sulfones such as sulfolan; carbonic acid esters such as dimethyl carbonate or ethylene carbonate; alkanes (paraffins); alkenes (olefins), alkynes; benzene and other aromatics having aliphatic and aromatic substituents; carboxylic acid esters; ethers, for example, diethyl ether; completely symmetrically constructed molecules such as tetramethyl silane or carbon tetrachloride; carbon disulfide, halogenated, aromatic, or dearomatized hydrocarbons.

The following are provided in particular as amphiprotic solvents: water, methanol, ethanol, and other alcohols (primary and secondary amines), carboxylic acids (formic acid, acetic acid), primary and secondary amides such as formamide; mineral acids (sulfuric acid, hydrogen halides and/or halogen hydracids).

In this case, unifying both miscible and also immiscible components in a fluid 6, 7, 8 or fluid mixture can be provided depending on the desired properties.

According to a further embodiment variant, it can furthermore be provided that the first fluid 6 or fluid mixture and/or the second fluid 7 or fluid mixture and/or the third fluid 8 or fluid mixture and/or the fourth fluid or fluid mixture and/or the fifth fluid or fluid mixture contains at least one solid additive material, in particular particles of pre-definable size and/or composition. These can be soluble or insoluble solids in this case. In this case, soluble solids are advantageously considered to be those solids which are first dissolved in a surrounding fluid by the action of forces and/or by the movement in relation to the fluid.

It is provided in particular in this case that the solid additive material, in particular the particles, contains metal powder and/or wood flour and/or carbon fibers and/or cellulose derivatives, plastic particles and/or elastomer particles and/or rock flour and/or silica particles and/or oxide particles and/or hydroxide particles.

Both the mass coating of the musical string and also the internal damping can be easily influenced by such additive materials. A further possibility for balancing out age-related changes of the musical string exists by way of the displacement of the mass coating during playing. In particular, such additive materials can increase the stability of the respective fluid or the mixing region. Moreover, they strongly influence the viscosity of the respective fluid.

Furthermore, such additives have different properties than fluids 6, 7, 8 without additives. Thus, for example, by selecting a combination of fluid 6, 7, 8 and solid additive material, it can thus be achieved that the particles of the additive material move more, and pass through the intermediate spaces between turns, for example, while the liquid and/or pourable components of the relevant fluid 6, 7, 8 remain in a larger proportion at the application location thereof. Opposite behavior can also be achieved by suitable selection of another combination.

According to a further embodiment variant, it can furthermore be provided that the first fluid 6 or fluid mixture and/or the second fluid 7 or fluid mixture and/or the third fluid 8 or fluid mixture and/or the fourth fluid or fluid mixture and/or the fifth fluid or fluid mixture contains at least one resin. In this case, this can be a soft resin or a hard resin or a mixture of a soft resin and a hard resin.

It is advantageously provided that the resin contains a saturated polyester resin and/or an unsaturated polyester resin and/or a polyurethane resin and/or an epoxy resin and/or a silicone resin and/or a vinyl ester resin and/or a phenol resin and/or an acrylic resin and/or a cellulose ester and/or a carboxylic acid ester and/or an alkyd resin and/or a resin ester and/or a tackifier and/or a rosin resin and/or a urethane resin and/or a maleic resin and/or a polymerized rosin.

To directly influence the stability and above all the viscosity, it is furthermore advantageously provided that the first fluid 6 and/or the second fluid 7 and/or the third fluid 8 and/or the fourth fluid and/or the fifth fluid contains at least one multivalent alcohol and/or a thixotropic agent and/or a wetting aid and/or a thickener.

To further improve the service life of the musical string it can furthermore be provided that the first fluid 6 and/or the second fluid 7 and/or the third fluid 8 and/or the fourth fluid and/or the fifth fluid contains at least one corrosion protection agent and/or an antioxidant and/or a nonferrous metal corrosion inhibitor.

Furthermore, it can advantageously be provided that the first fluid 6 and/or the second fluid 7 and/or the third fluid 8 and/or the fourth fluid and/or the fifth fluid contains at least one metal soap. Metal soaps have manifold properties, which have proven to be advantageous in applications in the field of a fluid of a musical string.

It has proven to be a further effective variant that the first fluid 6 and/or the second fluid 7 and/or the third fluid 8 and/or the fourth fluid and/or the fifth fluid contains at least one softener, in particular camphor.

According to a further embodiment variant, it can furthermore be provided that the first fluid 6 and/or the second fluid 7 and/or the third fluid 8 and/or the fourth fluid and/or the fifth fluid contains at least one emulsifier and/or stabilizer and/or dispersing agent and/or pigment and/or antistatic agent and/or preservative and/or binder and/or flux and/or desiccant.

Nine examples of present musical strings are described hereafter with respect to the fluids arranged thereon and, if necessary, the further embodiments of the respective musical string. In this case, these are development approaches, prototypes, and/or test series models, which had been performed at the time of the application, and which had proven to be advantageous.

First Example

The musical string 1 has a string core 2 embodied as a fiber bundle core comprising plastic fibers. In this case, the first fluid 6 is arranged between the core elements 3 and is embodied as a first fluid mixture, which contains 19% to 26% mineral oil extracts and 22% to 28% of at least one wax, wherein the remainder of the relevant first fluid mixture is formed by at least one resin. The relevant musical string 1 has a first winding layer 4, wherein the second fluid 7 is arranged on the turns of the first winding element 5, which is embodied as a second fluid mixture, which consists of 10% to 50% castor oil, 10% natural resin, 0% to 2.3% deer suet, and 25% rosin, wherein the remainder of the relevant second fluid mixture is formed by at least one wax.

Second Example

The musical string 1 has a string core 2 embodied as a steel wire. The string core 2 is externally enveloped by the first fluid 6. The first fluid 6 is embodied in this case as a first fluid mixture, which contains 10% to 15% turpentine oil and 0.5% wetting agent, wherein the remainder of the relevant first fluid mixture is formed by at least one wax. The relevant musical string 1 has a first winding layer 4, wherein the second fluid 7 is arranged on turns of the first winding element 5, which is embodied as a second fluid mixture, which contains 31% to 43% mineral oil, wherein the remainder of the relevant second fluid mixture is formed by at least one resin.

Third Example

The musical string 1 also has a string core 2 embodied as a fiber bundle core comprising plastic fibers. In this case, the first fluid 6, which is embodied as a first fluid mixture, which comprises 35% to 55% white oil and 1% wetting agent, wherein the remainder of the relevant first fluid mixture is formed by at least one wax, is arranged on a first circumferential section 11 of the string core 2, while the second fluid 7, which is embodied as at least one second fluid mixture, which contains 50% to 65% steric oil and 1.3% thickener, wherein the remainder of the relevant second fluid mixture is formed by at least one wax, is arranged on the second circumferential section 13 of the string core 2. The first pre-definable oscillating section of the musical string 1 extends in this case over the entire scale length of the musical string 1.

Fourth Example

The musical string 1 essentially corresponds to the musical string 1 according to the third example, wherein, however, the first oscillating section is limited to the region which is typically arranged between bridge and fingerboard of a musical instrument.

Fifth Example

The musical string 1 essentially corresponds in this case to the musical string 1 according to the third or fourth example, wherein, however, the first and the second fluid 6, 7 are not only arranged on circumferential sections 11, 13 of the string core 2, but rather the entire cross section of the string core 2 has a first and a second cross-sectional section, in particular is divided in two accordingly, and the first fluid 6, which is embodied as a first fluid mixture, which comprises 34% to 59% synthetic oil and 25% to 40% of at least one resin, wherein the remainder of the relevant fluid mixture is formed by at least one wax, is arranged on or in the first cross-sectional section of the string core 2, and the second fluid 7, which is embodied as a second fluid mixture, which comprises 10% to 26% synthetic oil and 32% to 48% of at least one resin, wherein the remainder of the relevant second fluid mixture is formed by at least one wax, is arranged on or in the second cross-sectional section of the string core 2.

The musical strings 1 according to the third, fourth, and/or fifth examples advantageously each have at least one first winding layer 4 in this case.

Sixth Example

The musical string 1 also has a string core 2 embodied as a fiber bundle core comprising plastic fibers. Furthermore, the musical string 1 has a first winding layer 4 and a second winding layer 9, which envelops the first winding layer 4 and adjoins directly thereon. The first fluid 6, which is embodied as a first fluid mixture, which contains 35% to 45% silicone oil, wherein the remainder of the relevant second fluid mixture is formed by silicone paste, is arranged on the turns of the first winding element 5. The second fluid 7, which is embodied as a second fluid mixture, which contains 55% to 69% silicone oil, wherein the remainder of the relevant second fluid mixture is formed by silicone gel, is arranged on turns of the second winding element 10.

Seventh Example

The musical string 1 has a string core 2 in the form of a wire cable. The first fluid 6, which is embodied as a first fluid mixture, which comprises 60% to 80% fat and 1.2% corrosion protection agent, wherein the remainder of the relevant first fluid mixture is formed by at least one resin, is arranged on the first winding layer circumferential section of the first winding layer 4. The second fluid 7, which is formed as a second fluid mixture, which comprises 40% vegetable oil and 15% soap, wherein the remainder of the relevant second fluid mixture is formed by at least one wax, is arranged on the second winding layer circumferential section of the first winding layer 4. The two winding layer circumferential sections ideally have in this case essentially the form of two interlocking halves of a tube which is divided in two in longitudinal extension.

Eighth Example

The musical string 1 has a string core 2 in the form of a wire cable. The first fluid is arranged inside the string core, therefore in the intermediate spaces of the wire cable, which is embodied as a first fluid mixture, which comprises 60% to 80% fat and 1.2% corrosion protection agent, wherein the remainder of the relevant first fluid mixture is formed by at least one resin. A first winding layer and a second winding layer, which is wound concentrically thereto, are arranged around the string core 2. In the first winding layer, therefore in the intermediate spaces between the turns of the first winding element, the second fluid is arranged, which is embodied as a second fluid mixture, which comprises 40% vegetable oil and 15% soap, wherein the remainder of the relevant second fluid mixture is formed by at least one wax.

It can occur, in particular in the course of playing the relevant musical string, that a fluid, in the case of the eighth example in particular the second fluid, penetrates into regions in which previously no fluid is or was arranged. In the present case, into the intermediate spaces between the first and second winding layers and/or into the intermediate spaces between the turns of the second winding element. This effect can also occur in musical strings other than only the described eighth example.

Ninth Example

The musical string 1 has a string core 2 in the form of a wire cable. The first fluid, which is embodied as a first fluid mixture, which comprises 60% to 80% fat and 1.2% corrosion protection agent, wherein the remainder of the relevant first fluid mixture is formed by at least one resin, is arranged on the circumference of the string core. A first winding layer and a second winding layer, which is wound concentrically thereto, are arranged around the string core 2. The second fluid, which is embodied as a gel, is arranged in the first winding layer, therefore in the intermediate spaces between the turns of the first winding element. A third fluid, which is embodied as a third fluid mixture, which comprises 40% vegetable oil and 15% soap and 25% to 55% of at least one wax, wherein the remainder of the relevant third fluid mixture is formed by at least one resin, is arranged in the second winding layer, therefore in the intermediate spaces between the turns of the second winding element.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A musical string, in particular for bowed and/or plucked instruments, comprising:

a first musical string part;

a first fluid provided on the first musical string part;

a second musical string part;

a second fluid provided on the second musical string part, said second fluid being different from the first fluid, wherein the first fluid and the second fluid are arranged spaced apart from one another; and at least one first pre-definable oscillating section in which the first fluid and the second fluid are arranged to form a first mixing region, wherein the first fluid and the second fluid are liquid.

2. The musical string of claim 1, wherein the first musical string part is a member selected from the group consisting of string core of the musical string, first circumferential section of the string core, first cross-sectional section of the string core, first winding layer of the musical string, first winding element of the first winding layer, second winding layer of the musical string, and second winding element of the second winding layer, wherein the second musical string part is a member selected from the group consisting of string core of the musical string, second circumferential section of the string core, second cross-sectional section of the string core, first winding layer of the musical string, first winding element of the first winding layer, second winding layer of the musical string, and second winding element of the second winding layer, wherein the first musical string part is different from the second musical string part.

3. The musical string of claim 2, wherein the first fluid is arranged on the string core and/or between core elements of the string core, and the second fluid is arranged on the first winding layer and/or on turns of the first winding element.

4. The musical string of claim 2, wherein the first fluid is arranged on the first circumferential section of the string core, and the second fluid is arranged on the second circumferential section of the string core.

5. The musical string of claim 2, wherein the first fluid is arranged on the first cross-sectional section of the string core, and the second fluid is arranged on the second cross-sectional section of the string core.

6. The musical string of claim 2, wherein the first fluid is arranged on the first winding layer and/or on the turns of the first winding element, and the second fluid is arranged on the second winding layer of the musical string and/or on turns of the second winding element.

7. The musical string of claim 2, wherein the first fluid is arranged on a first circumferential section of the first winding layer, and the second fluid is arranged on a second circumferential section of the first winding layer.

8. The musical string of claim 1, wherein the first fluid has a first viscosity, said second fluid having a second viscosity which is different from the first viscosity.

9. The musical string of claim 1, wherein, in the event of a pre-definable intended excitation of the musical string, the second fluid comes into contact with the first fluid, thereby forming the first mixing region having a mixing region viscosity, wherein the mixing region viscosity is different from a first viscosity of the first fluid.

10. The musical string of claim 1, wherein the second fluid and the second musical string part are configured such that in the event of a pre-definable intended excitation of the musical string, the second fluid penetrates free spaces of the second musical string part to form the first mixing region.

11. The musical string of claim 1, wherein the first fluid is arranged adjacent to the second fluid, in particular directly adjoining the second fluid.

12. The musical string of claim 1, further comprising a third fluid which is different from the first fluid and the second fluid, said third fluid being arranged between the first fluid and the second fluid to form a triple mixing region.

13. The musical string of claim 1, further comprising a string core including a pre-definable plurality of core elements, each said core element being wetted with the first fluid and/or the second fluid.

14. The musical string of claim 1, further comprising a second pre-definable oscillating section configured for accommodation of a fourth fluid which is different from the first fluid, said second pre-definable oscillating being different from the first pre-definable oscillating section and forming a second mixing region on the first musical string part, wherein a fifth fluid, which is different from the second fluid, is arranged on the second musical string part.

15. The musical string of claim 14, further comprising a third fluid which is different from the first fluid and the second fluid, said third fluid being arranged between the first fluid and the second fluid to form a triple mixing region, wherein at least one fluid selected from the group consisting of the first fluid, the second fluid, the third fluid, the fourth fluid, and the fifth fluid, has a pre-definable variable length distribution within the first and/or a second oscillating section of the musical string.

16. The musical string of claim 14, further comprising a third fluid which is different from the first fluid and the second fluid, said third fluid being arranged between the first fluid and the second fluid to form a triple mixing region, wherein at least one fluid selected from the group consisting of the first fluid, the second fluid, the third fluid, the fourth fluid, and the fifth fluid, is configured essentially as an organic fluid or fluid mixture.

17. The musical string of claim 14, further comprising a third fluid which is different from the first fluid and the second fluid, said third fluid being arranged between the first fluid and the second fluid to form a triple mixing region, wherein at least one fluid selected from the group consisting of the first fluid, the second fluid, the third fluid, the fourth fluid, and the fifth fluid, contains at least one wax or wax mixture.

18. The musical string of claim 17, wherein the wax or wax mixture comprises at least one material selected from the group consisting of animal wax, vegetable wax, mineral wax, and synthetic wax.

19. The musical string of claim 14, further comprising a third fluid which is different from the first fluid and the second fluid, said third fluid being arranged between the first fluid and the second fluid to form a triple mixing region, wherein at least one fluid selected from the group consisting of the first fluid, the second fluid, the third fluid, the fourth fluid, and the fifth fluid, contains at least one oil.

20. The musical string of claim 19, wherein the oil comprises at least one material selected from the group consisting of fatty animal oil, fatty vegetable oil, ethereal oil, mineral oil, synthetic oil, silicone oil, and silicone paste.

21. The musical string of claim 14, further comprising a third fluid which is different from the first fluid and the second fluid, said third fluid being arranged between the first fluid and the second fluid to form a triple mixing region, wherein at least one fluid selected from the group consisting of the first fluid, the second fluid, the third fluid, the fourth fluid, and the fifth fluid, contains at least one fat.

22. The musical string of claim 21, wherein the fat comprises at least one material selected from the group consisting of lard, in particular pork lard, whale oil, suet, in particular deer suet.

23. The musical string of claim 14, further comprising a third fluid which is different from the first fluid and the second fluid, said third fluid being arranged between the first fluid and the second fluid to form a triple mixing region, wherein at least one fluid selected from the group consisting of the first fluid, the second fluid, the third fluid, the fourth fluid, and the fifth fluid, contains at least one solvent.

24. The musical string of claim 23, wherein the solvent comprises at least one protic and/or amphiprotic solvent.

25. The musical string of claim 14, further comprising a third fluid which is different from the first fluid and the second fluid, said third fluid being arranged between the first fluid and the second fluid to form a triple mixing region, wherein at least one fluid selected from the group consisting of the first fluid, the second fluid, the third fluid, the fourth fluid, and the fifth fluid, contains at least one gel.

26. The musical string of claim 14, further comprising a third fluid which is different from the first fluid and the second fluid, said third fluid being arranged between the first fluid and the second fluid to form a triple mixing region, wherein at least one fluid selected from the group consisting of the first fluid, the second fluid, the third fluid, the fourth fluid, and the fifth fluid, contains at least one solid additive material, in particular particles of pre-definable size and/or composition.

27. The musical string of claim 26, wherein the solid additive material, in particular the particles, contain at least one material selected from the group consisting of metal powder, wood flour, carbon fibers, cellulose derivatives, plastic particles, elastomer particles, rock flour, silica particles, oxide particles, and hydroxide particles.

28. The musical string of claim 14, further comprising a third fluid which is different from the first fluid and the second fluid, said third fluid being arranged between the first fluid and the second fluid to form a triple mixing region, wherein at least one fluid selected from the group consisting of the first fluid, the second fluid, the third fluid, the fourth fluid, and the fifth fluid, contains at least one resin.

29. The musical string of claim 28, wherein the resin contains at least one material selected from the group consisting of a saturated polyester resin, an unsaturated polyester resin, a polyurethane resin, an epoxy resin, a silicone resin, a vinyl ester resin, a phenol resin, an acrylic resin, a cellulose ester, a carboxylic acid ester, alkyd resin, a resin ester, a tackifier, a rosin resin, a urethane resin, a maleic resin, and a polymerized rosin.

30. The musical string of claim 14, further comprising a third fluid which is different from the first fluid and the second fluid, said third fluid being arranged between the first fluid and the second fluid to form a triple mixing region, wherein at least one fluid selected from the group consisting of the first fluid, the second fluid, the third fluid, the fourth fluid, and the fifth fluid, contains at least one material selected from the group consisting of multivalent alcohol, a thixotropic agent, a wetting aid, and a thickener.

31. The musical string of claim 14, further comprising a third fluid which is different from the first fluid and the second fluid, said third fluid being arranged between the first fluid and the second fluid to form a triple mixing region, wherein at least one fluid selected from the group consisting of the first fluid, the second fluid, the third fluid, the fourth fluid, and the fifth fluid, contains at least one material selected from the group consisting of corrosion protection agent, an antioxidant, and a nonferrous metal corrosion inhibitor.

32. The musical string of claim 14, further comprising a third fluid which is different from the first fluid and the second fluid, said third fluid being arranged between the first fluid and the second fluid to form a triple mixing region, wherein at least one fluid selected from the group consisting of the first fluid, the second fluid, the third fluid, the fourth fluid, and the fifth fluid, contains at least one metal soap.

33. The musical string of claim 14, further comprising a third fluid which is different from the first fluid and the second fluid, said third fluid being arranged between the first fluid and the second fluid to form a triple mixing region, wherein at least one fluid selected from the group consisting of the first fluid, the second fluid, the third fluid, the fourth fluid, and the fifth fluid, contains at least one softener, in particular camphor.

34. The musical string of claim 14, further comprising a third fluid which is different from the first fluid and the second fluid, said third fluid being arranged between the first fluid and the second fluid to form a triple mixing region, wherein at least one fluid selected from the group consisting of the first fluid, the second fluid, the third fluid, the fourth fluid, and the fifth fluid, contains at least one material selected from the group consisting of emulsifier, stabilizer, dispersing agent, pigment, antistatic agent, preservative, binder, flux, and desiccant.

35. The musical string of claim 1, further comprising a string core including a pre-definable plurality of core elements, which are embodied as plastic fibers, each said core element being wetted with the first fluid and/or the second fluid.

* * * * *